US006461398B2

(12) United States Patent
Peters et al.

(10) Patent No.: US 6,461,398 B2
(45) Date of Patent: Oct. 8, 2002

(54) REGENERABLE PARTICLE FILTER FOR THE REMOVAL OF SOOT PARTICLES FROM EXHAUST GASES

(75) Inventors: Bruce Peters, Wiesbaden; Peter Zima, Mainz; Karl Heinz Friedel, Ginsheim, all of (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/780,022

(22) Filed: Feb. 9, 2001

(65) Prior Publication Data

US 2001/0017026 A1 Aug. 30, 2001

(51) Int. Cl.[7] ..... B01D 39/20

(52) U.S. Cl. ..... 55/523; 55/385.3; 55/DIG. 10; 55/DIG. 28; 55/DIG. 30; 422/174; 422/177; 422/178; 422/180; 60/303; 60/311

(58) Field of Search ..... 55/385.3, 523, 55/DIG. 10, DIG. 30, DIG. 28; 422/174, 177, 178, 180; 60/303, 311

(56) References Cited

U.S. PATENT DOCUMENTS

| | | | | | |
|---|---|---|---|---|---|
| 4,519,820 | A | * | 5/1985 | Oyobe et al. | 55/DIG. 10 |
| 4,976,929 | A | * | 12/1990 | Cornelison et al. | 422/174 |
| 5,254,840 | A | * | 10/1993 | Thompson | 422/174 |
| 5,457,945 | A | * | 10/1995 | Adiletta | 55/DIG. 30 |
| 5,782,941 | A | * | 7/1998 | Matsunuma et al. | 55/DIG. 10 |
| 6,024,927 | A | * | 2/2000 | Ban et al. | 422/174 |
| 6,101,793 | A | * | 8/2000 | Nagai et al. | 55/523 |

FOREIGN PATENT DOCUMENTS

| | | |
|---|---|---|
| DE | 3529684 A1 | 2/1987 |
| DE | 3622623 A1 | 1/1988 |
| DE | 3623600 A1 | 1/1988 |
| DE | 3902812 C1 | 1/1990 |
| DE | 3824578 C2 | 2/1992 |
| DE | 4103653 C1 | 6/1992 |
| DE | 19824285 A1 | 12/1999 |
| EP | 0383187 B1 | 2/1990 |

* cited by examiner

*Primary Examiner*—David A. Simmons
*Assistant Examiner*—Minh-Chan T. Pham
(74) *Attorney, Agent, or Firm*—Leslie C. Hodges

(57) ABSTRACT

The invention concerns a regenerable particle filter for removing soot particles from exhaust gases, especially from diesel engines. In a filter housing, a ceramic filter body is arranged between an exhaust gas supply pipe and an exhaust gas discharge pipe. The filter body has a large number of channels distributed over the cross section in a honeycomb or checkerboard pattern. The channels are closed alternately at their ends so that the exhaust gas after entering into one group of channels must flow through the porous walls to the other group of channels in order then to arrive at the exhaust gas discharge pipe. Electric heating elements are arranged at the closed end of the channels open toward the exhaust gas supply pipe. Upon heating they ignite the soot particle deposit which accumulates here to an elevated degree. Since scarcely any gas flow prevails in the vicinity of the heating elements good combustion of the soot takes place and therefore a reliable regeneration of the filter.

4 Claims, 1 Drawing Sheet

REGENERABLE PARTICLE FILTER FOR THE REMOVAL OF SOOT PARTICLES FROM EXHAUST GASES

TECHNICAL FIELD

This invention concerns a regenerable particle filter for removing soot particles from exhaust gases.

BACKGROUND OF THE INVENTION

Such a device for purifying the exhaust gases from diesel engines is described in DE 38 24 578 C2. In this device, inside the filter housing and in the direction of flow in front of the filter body, an electric heating device is present for heating the inflowing exhaust gas to a temperature which is sufficient to ignite the soot particles deposited in the channels of the filter body. Since the entire quantity of exhaust gas must be heated to the ignition point, a considerable quantity of energy is necessary for this which is generally unavailable in a motor vehicle.

In order to reduce the energy costs for reaching the ignition point for soot deposited on ceramic filters in a conventional soot filter for diesel engines, it is proposed in DE 35 29 684 A1 that partial segments of the filter be provided with electric heaters and that the quantity of exhaust gas flowing through the partial segments be electrically heated successively segment by segment to the ignition point of the soot.

Since a stream of gas is also used in this soot filter as the medium for heat transfer from the electric heaters to the soot deposits, here also very high heating capacities are required which are also necessary during the entire regeneration process.

DE 36 22 623 A1 describes an apparatus for removing the soot retained in the exhaust gas filter of an internal combustion engine in which the soot deposited on the filter is ignited by the electric current flowing through the soot deposit itself, because the deposited soot acts as a heat conductor.

Such a device, however, does not operate reliably since the consistency of the soot deposit is not always constant and therefore currents of different intensity are required for heating.

De 39 02 812 C1 describes an electrostatic separator for separating soot particles from the stream of exhaust gas from incineration devices or combustion engines and their catalytically initiated combustion triggered by an electric heating device. As a heating device here a heat conductor wrapped around the outer circumference of an insulator for a high voltage electrode is used which is additionally coordinated with a thermostatically regulated electric heating device whose surface is designed as a catalyst.

Such a device is very costly to construct and scarcely applicable in a motor vehicle because of the costs involved.

EP 0 383 187 B1 describes a system for regenerating a particle filter in which electrically heated air is transported by an air pump to the front side of the filter. The cost here is also considerable and too high for a conventional motor vehicle.

DE 41 03 653 C1 describes a soot burn-off filter of porous ceramic material with alternately closed exhaust gas channels for filtration of the exhaust gases from diesel engines and with a high voltage ignition system arranged on the exhaust gas outlet side of the filter. One of the high voltage electrodes in this case runs along the exhaust gas channels in the filter. The other electrode lies on the exhaust gas outlet side. The closing plug of the exhaust gas channel is used as the electrode support. The soot deposits are ignited by a spark jump between the electrodes. The disadvantage is that for this filter a high voltage must be generated, and precautions must be taken in order to prevent people from coming into contact with the high voltage parts.

DE 198 24 285 A1 describes a soot filter in which, in order to reduce the ignition point of the soot particles, the ceramic filter body is made up of knit fabric of very fine ceramic threads which have a heat-proof wire drawn through them and are provided with a catalytic coating. Such a soot filter does indeed lower the ignition point of the soot. Selective regeneration, however, can be achieved only by modulating the exhaust gas temperature, which in turn necessitates intervention in the engine combustion process. Such a soot filter is also relatively costly.

SUMMARY OF THE INVENTION

The invention has the objective of devising a regenerable particle filter for removing soot particles from exhaust gases, especially exhaust gases from diesel engines installed in motor vehicles, which filter can be produced and operated at relatively low cost, and can be regenerated with an energy expenditure acceptable onboard a motor vehicle and whose regeneration process takes places without supplying additional energy after starting.

In a generic particle filter the exhaust gas stream on one side of the filter body enters into the open channels on said side, flows through the pores of the walls and in this way passes into the open channels of the filter body on the downstream side. The soot particles present in the exhaust gas stream are retained on the surface of the porous walls inside the channels open on the intake side. Since the flow velocity of the exhaust gas inside these channels decreases steadily up to their closed ends the particles reduce their velocity as a result of their mass, but to a lesser degree than the gas, so that the particles accumulate at the closed end of the channel more strongly than on the parts of the walls lying further toward the inlet opening. By arranging heating elements on the closed rear end of this channel, the quantity of deposited soot particles can be ignited there to an intensified degree. This is also superior to the case of known soot filters with heating devices in the exhaust gas inlet to the extent that the exhaust gas with a temperature lower than the ignition point flowing into the filter body moves forward only with low intensity up to the closed end of the channel and therefore cannot cool the surroundings of the heating element. After ignition of the significant quantity of soot particles lying against the heating element the adjacent temperature is further increased by the combustion of the soot particles and the combustion process propagates in the soot particles deposited along the channel wall in the direction of the gas inlet opening. The $CO_2$ and CO forming during this combustion can pass through the porous wall of the filter body and are decontaminated in a catalyst connected after the particle filter.

The ignition and burning behavior of the soot particle deposit can be further improved by catalytic coating of the walls of the channels of the filter body receiving the exhaust gas with a catalyst which lowers the ignition point of the diesel soot.

It is also possible to provide a surface facing the channels of the heating elements with catalytic coating which reduces the ignition point of the soot.

BRIEF DESCRIPTION OF THE DRAWINGS

An example of embodiment of the invention is described in detail with reference to the following drawings, in which.

DESCRIPTION OF THE PREFERRED EMBODIMENT

Figure 1:
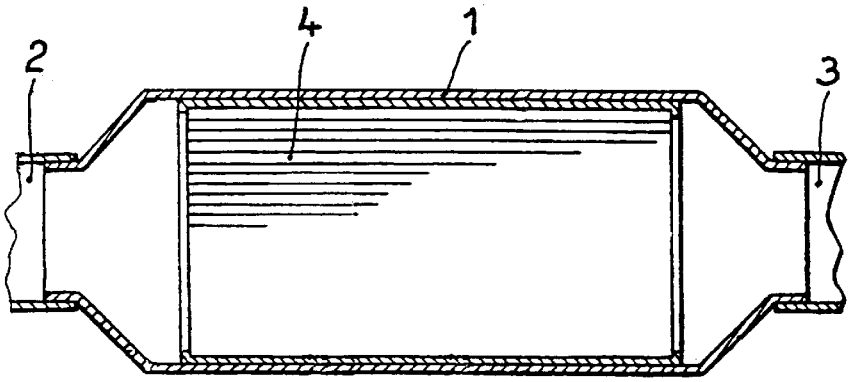
FIG. 1 shows a regenerable particle filter according to the invention in cross-section.
Figure 2:
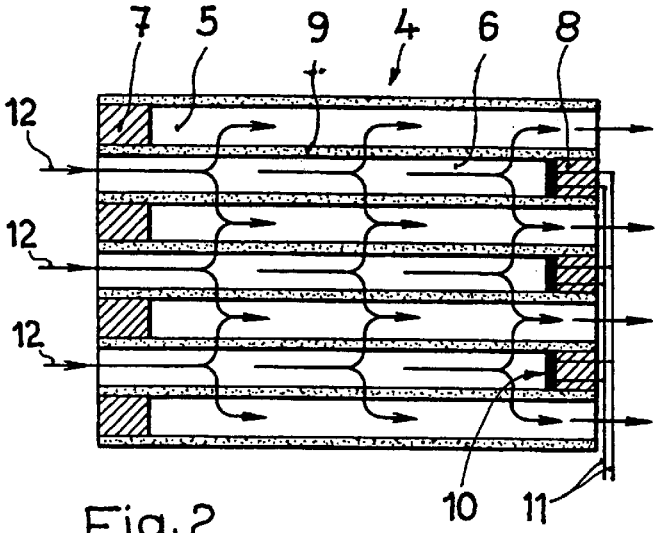
FIG. 2 is an enlarged representation of a section through the filter body of the particle filter in FIG. 1.
Figure 3:
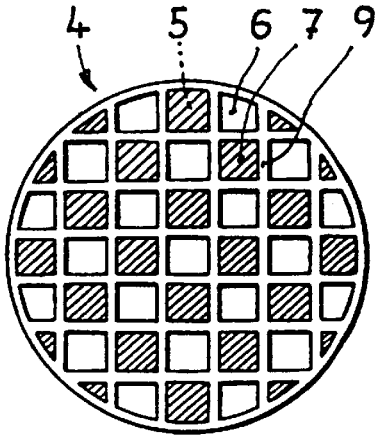
FIG. 3 is a view in the direction of flow at the end side of the filter body in FIG. 2.

A filter housing 1 with an essentially cylindrical shape has an exhaust gas supply pipe 2 at one side and on the other side an exhaust gas discharge pipe 3. The filter housing 1 encompasses a ceramic filter body 4 between the exhaust gas supply pipe 2 and the exhaust gas discharge pipe 3. The filter body 4 has a large number of channels 5,6 distributed in a checkerboard pattern over the cross section aligned in the flow direction of the exhaust gas. A first part of these channels is closed at its end facing toward the exhaust gas supply pipe 2 with stoppers 7. The remaining channels 6 which are adjacent to the first channels 5 in each case are closed at the end facing the exhaust gas discharge pipe 3 by the closing pieces 8. The first channels 5 and the neighboring other channels 6 are separated from each other by porous walls 9. The closing pieces 8 are provided with electric heating elements 10 running in the direction of the interior of the channels 6. Electrical conductors 11 lead to the electric heating elements 10 through which said heating elements 10 can be supplied with electrical energy. The arrows 12 indicate the flow path of the exhaust gas through the filter body 4 (FIG. 2).

Figure 4:
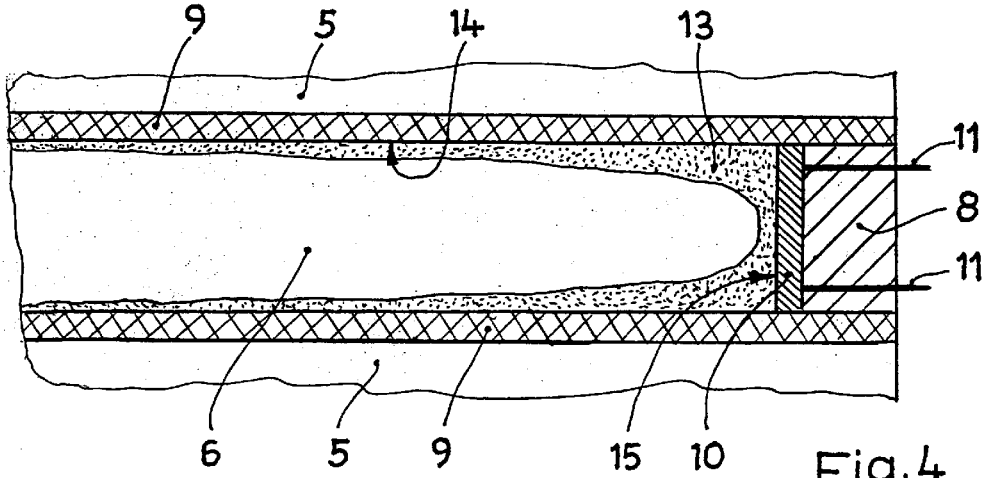
FIG. 4 is an enlarged representation of a channel end of the filter body with soot particle deposits in cross-section.

In FIG. 4 a soot particle deposit 13 is shown in a channel 6 open toward the exhaust gas supply pipe 2. The surface 14 of the walls 9 of the channels 6 open toward the exhaust gas supply pipe 2 as well as the surface 15 pointing to these channels 6 of the heating elements 10 are provided with a catalytic coating which lowers the ignition point of the soot. Such a coating is disclosed, for example, in DE 36 23 600 A1.

A regenerable particle filter of the type described is arranged in a diesel combustion engine between the engine and a catalyst. The exhaust gas coming from the engine passes through the exhaust gas supply pipe 2 to the filter housing 1 and passes into the channels 6 of the filter body 4 which are open toward the exhaust gas supply pipe 2. From these channels 6 the gas penetrates the porous walls 9 in order to arrive in the channels 5 of the filter body 4 that are open toward the exhaust gas discharge pipe 3, at which time the soot particles carried along in the exhaust gas are retained on the walls 9. At this time the flow velocity of the exhaust gas inside the first channel 6 is constantly diminishing until it is almost zero in the vicinity of the heating elements 10. The soot particles carried along in the exhaust gas retain part of their velocity and thus form a soot particle deposit 13 which is thicker near the heating element 10 than on the other surfaces 14 of the walls 9 running toward the exhaust gas supply pipe 2.

Now, for example, if it is known from an electronic motor control that the passage resistance of the exhaust gas through the particle filter has exceeded an acceptable value, then the heating elements 10 are heated with electrical energy up to a temperature at which the soot particle deposit 13 is ignited, at which time simultaneously the diesel engine can be operated with excess air by known means. At this time the ignition can take place simultaneously on all heating elements 10 or also in groups or in succession in order to be able to work temporarily at lower electrical power.

Since a large proportion of the soot particle deposit 13 is located in the immediate vicinity of the heating element 10 as a result of the design of the particle filter according to the invention, this large part of the deposit is also ignited initially. The additionally produced heat at this time has the result that the burn-off along the walls 9 of the filter body 14 in the opposite direction tot he exhaust gas flow passes further into the ignited channel 6 and in so doing regenerates the filter function.

The catalytic coating on the surfaces 14 of the walls 9 of the filter body and the surface 15 of the heating elements supports the filter regeneration.

The gases forming during the burn-off of the soot particle deposits 13 together with the other exhaust gas components pass through the pores of the walls 9 and, if necessary, are purified in a catalyst located after the particle filter.

What is claimed is:

1. A regenerable particle filter for removing soot particles from exhaust gases, especially the exhaust gases from diesel engines, with a filter housing displaying an exhaust gas supply pipe and an exhaust gas discharge pipe, a ceramic filter body arranged between the exhaust gas supply pipe and the exhaust gas discharge pipe which displays a large number of channels running in a honeycomb or checkerboard pattern distributed over the cross section in the flow direction of the exhaust gas, where in each case alternately one part of the channels at the end facing the exhaust gas supply pipe and the other part at the end facing the exhaust gas discharge pipe is closed, the channels are separated by porous walls from each other and electric heating elements are provided for heating the soot particles deposited on the filter body to the ignition point, comprising the heating elements being arranged inside the closed ends of the channels of the filter body facing away from the exhaust gas supply pipe.

2. A regenerable particle filter as in claim 1, comprising the heating elements being affixed on the inner side of the closing pieces for closing the ends of the channels of the filter body facing away from the exhaust gas supply pipe.

3. A regenerable particle filter as in claim 1 or 2, comprising the surface of the walls at least of the channels of the filter body facing toward the exhaust gas supply pipe being provided with a catalytic coating which lowers the ignition point of the soot.

4. A regenerable particle filter as in claim 1 or 2, comprising the surface of the heating element facing toward the channels being provided with a catalytic coating which lowers the ignition point of the soot.

* * * * *